US006369309B1

(12) United States Patent
Nishida

(10) Patent No.: US 6,369,309 B1
(45) **Date of Patent: *Apr. 9, 2002**

(54) KEYBOARD ASSEMBLY

(75) Inventor: Kenichi Nishida, Hamamatsu (JP)

(73) Assignee: Yamaha Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/026,739

(22) Filed: Feb. 20, 1998

(30) Foreign Application Priority Data

Feb. 24, 1997 (JP) ..... 9-054266
Feb. 24, 1997 (JP) ..... 9-054267

(51) Int. Cl.[7] ..... G10C 3/12

(52) U.S. Cl. ..... 84/423 R; 84/433; 84/434; 84/435; 84/436

(58) Field of Search ..... 84/423 R, 433, 84/434, 435, 436

(56) References Cited

U.S. PATENT DOCUMENTS 5,131,308 A * 7/1992 Katsuta ..... 84/434
5,821,443 A * 10/1998 Masubushi ..... 84/433

FOREIGN PATENT DOCUMENTS

| | | |
|---|---|---|
| JP | 3-100894 | 10/1991 |
| JP | 4-72287 | 6/1992 |
| JP | 5-181456 | 7/1993 |
| JP | 6-31939 | 4/1994 |
| JP | 6-318076 | 11/1994 |
| JP | 8-146943 | 6/1996 |

* cited by examiner

*Primary Examiner*—Shih-Yung Hsieh
(74) *Attorney, Agent, or Firm*—Morrison & Foerster LLP

(57) ABSTRACT

A key support member of a keyboard assembly pivotally supports a plurality of keys each including a body, a hinge portion, and a rear end portion. A movably-mounting device is used to mount the keys onto the key support member via the rear end portion of the each of the keys in a manner such that the keys can be moved by moving the rear end portion of the each of the keys. When the keys have been mounted on the key support member, the movably-mounting device engages the keys with the key support member in a manner such that the keys are movable relative to the key support member.

28 Claims, 10 Drawing Sheets

KEYBOARD ASSEMBLY

BACKGROUND OF THE INVENTION

1. Field of the Invention

This invention relates to a keyboard assembly, and more particularly to a keyboard assembly which is improved in the facility of assemblage thereof.

2. Prior Art

Conventionally, a keyboard assembly used in musical instruments operated by using a keyboard, such as an electronic piano, is assembled by separately fabricating keys and a key support member such as a key frame, and then mounting the keys on the key support member. In general, the key support member of the keyboard assembly has key depression-detecting means, such as key switches, mounted thereon for detecting depression of the respective keys. The key depression-detecting means have resilient expanded portions made e.g. of rubber. Each key has an actuator formed thereon for depressing a corresponding one of the resilient expanded portions when it is depressed or operated by the player, and when the depression of the key is detected by the key depression-detecting means, a key-on signal is generated.

To ensure proper functioning of the key depression-detecting means, each key is required to be mounted at a location at which the actuator of the key is properly brought into abutment with the resilient expanded portion. To this end, a conventional keyboard assembly has been proposed by Japanese Laid-Open Patent Publication (Kokai) No. 6-110450, which includes a guide member provided on the bottom of a common rear end portion of each key, which serves not only as positioning means but also as guiding means for guiding the key when it is mounted, and a hole corresponding to the guide member, which is formed in a key support member. The guide member is inserted into the hole for positioning the key, and then the common rear end portion of the key is fixed to the key support member by a screw or the like.

Another conventional keyboard assembly proposed by the above-mentioned Japanese Laid-Open Patent Publication (Kokai) No. 6-318076 includes a single dowel pin provided on each key unit in a fashion protruding from the bottom of a common rear end portion of keys, a hole formed in a key support member for receiving the dowel pin, and a projection formed on the key support member, for abutment with a rear end of the common rear end portion of the keys. The dowel pin holds the key unit at one contact point, and the projection prevents the key unit from undergoing a slight horizontal pivotal motion about the dowel pin, to thereby hold the key unit (and hence keys) in position. Further, finally, the common rear end portion of the keys is fixed to the key support member by screws.

Normally, the key depression-detecting means, the key support member, and the keys are fabricated separately. Therefore, improper contact or abutment of each actuator on the corresponding resilient expanded portion can be caused not only by manufacturing tolerances of the component parts but also by positioning or alignment errors therebetween (mounting errors). Further, when a plurality of key units are mounted on the body of the keyboard assembly, one key unit can suffer from similar inconveniences ascribable to tolerances or mounting errors of component parts of another key unit.

Even if there are such tolerances or mounting errors, so long as the bottom of each actuator is flat in shape and has a sufficient longitudinal length, an error in the longitudinal position of the key can be accommodated to some extent whereby it is possible to bring the actuator into contact with the resilient expanded portion to a proper extent. However, an error in the lateral position of each key can be accommodated only to a very slight extent due to a limited width thereof. If such an error cannot be accommodated or compensated for, the key (or key unit) is regarded as defective, and the mounting of a key (or key unit) has to be carried out again, resulting in not only degraded productivity but also a lowered yield of keys, which leads to an increase in the manufacturing cost.

FIG. 1 shows an outline of the construction of a conventional keyboard assembly, which is in a pre-assembled state.

In the conventional keyboard assembly, keys are preassembled into key units 91, each formed as a laminate of white keys and black keys, and mounted on a key support member 92. The mechanism of the keyboard assembly imposes various requirements on the manner of mounting the key units 91 on the key support member 92.

First, a key switch 93 as key depression-detecting means operates to detect depression of a key corresponding thereto by sensing an urging force of the key acting thereon. Therefore, after the key unit 91 has been mounted on the key support member 92, when a key is in a released state, normally, an actuator 94 formed on the key lightly contacts the resilient expanded portion of the key switch 93. On the other hand, during the mounting process of the key unit 91 on the key support member 92, to prevent the actuator 94 from applying a horizontal external force to the resilient expanded portion, which leads to peeling and deformation of the resilient expanded portion, it is desirable that the actuator 94 abuts or urges the resilient expanded portion vertically or from right above. Although peeling and deformation of the resilient expanded portion can be prevented by increasing the hardness thereof, this degrades a key touch sensed when the key is depressed. Therefore, the actuator 94 and the resilient expanded portion are required to be kept out of contact from each other up to a stage immediately before the mounting process of the key unit 91 is finished when the key unit is no longer moved horizontally.

For example, in the conventional keyboard assembly, each key 91 has a guide projection 96 formed on the bottom of a rear end portion (common rear end portion 95) thereof, and at the same time, the key support member 92 has a hole 97 formed therein for having the guide projection 96 fitted therein when the key unit 91 has been mounted, whereby the rear half of each key is supported by the guide projection 96 up to a stage immediately before the mounting of the key unit 91 is completed. Further, during the mounting process of the key unit 91, the front half of each key is supported by the top of a key guide 98 (provided for preventing a transverse sway or twist of the key when it is depressed). Other examples are disclosed in Japanese Laid-Open Patent Publications (Kokai) Nos. 6-318076 and 8-123419, in which a guide member for supporting the rear half of each key is provided not on the key unit 91 but on the key support member 92 for the ease of handling of the key before mounting of the key unit.

Further, a plurality of guide members for assisting the mounting operation of the key unit 91, such as the guide projection 96, are normally provided. However, these members should not interfere with key depressing operations by the operator or player. In the conventional keyboard assembly, after the key unit 91 has been mounted, the guide projection 96 are fitted in the holes 97 to thereby prevent the guide projection from interfering with key-depressing operations by the user.

Further, it is necessary to provide a so-called upper limit stopper for setting an upper limit position of a front end (operator side-end) of each key when the key is a released state after the mounting of the key unit 91. For example, in the conventional keyboard assembly, each key is integrally formed with a follower portion 99 which is slidably guided by the key guide 98, and the follower portion 99 has an engaging end 99*a* formed integrally at a lower end thereof for abutting on a stopper, not shown, provided at a location close to a lower end of the key guide 98 when the depressed key returns to its original released position.

Furthermore, to facilitate accurate mounting operations of keys, means for controlling the position of each key in a lateral direction, i.e. in a direction in which keys are juxtaposed is indispensable. In the conventional keyboard assembly, for example, the position of each key in the lateral direction is controlled by lateral opposite sides of the key guide 98 which controls the lateral position of the follower portion 99 of the key.

During the mounting process of the key unit 91, the key unit 91 is slid rearward, and then moved downward. According to the above construction of the conventional key board assembly, as the key unit 91 is slid rearward, the engaging end 99*a* is horizontally moved rearward below the key guide 98, and, immediately before termination of the mounting of the key unit 91, the actuator 94 abuts the resilient expanded portion of the key switch 93 from right above. This enables the key unit 91 to be properly mounted on the key support member 92 while avoiding peeling and deformation of the resilient expanded members and other inconveniences.

However, in the conventional keyboard assembly, the key guide 98 (top end thereof) of the key support member for supporting the front end of each key is closer to a central portion of the key rather than the rear end portion of the same, so that the support of the key by the key guide is not stable enough to easily carry out a mounting operation of the key unit 1 on the key support member.

Further, the key guide 98 is provided for each of the keys. Therefore, it is required to set the top of each key guide 98 to a suitable height, which complicates the construction of the keyboard assembly, and increases the manufacturing cost.

Further, the guide member for supporting the rear end portion of each key, such as the guide projection 96, does not play any role after the mounting of each key (key unit) is completed, and provision of such guide members undesirably narrows the mounting space for accommodating other component parts of the keyboard assembly.

SUMMARY OF THE INVENTION

It is a first object of the invention to provide a keyboard assembly which is capable of lessening the required accuracy of mounting of each key to thereby improve the productivity and reduce the manufacturing cost.

It is a second object of the invention to provide a keyboard assembly which is simple in construction and low in manufacturing cost but enables keys to be more easily mounted on a key support member to thereby improve the ease of assemblage of the keyboard assembly.

It is a third object of the invention to provide a keyboard assembly which is simple in construction and low in manufacturing cost but is capable of saving the mounting space while maintaining the ease of handling keys before or during mounting of them, and further capable of preventing degradation of a key touch sensed when each key is depressed as well as peeling and deformation of each resilient expanded portion.

To attain the first object of the invention, according to a first aspect of the invention, there is provided a keyboard assembly comprising a plurality of keys, each of the keys including a body, a hinge portion, and a rear end portion, a key support member for pivotally supporting the keys, and movably-mounting means for mounting the keys onto the key support member via the rear end portion of the each of the keys in a manner such that the keys can be moved by moving the rear end portion of the each of the keys, and wherein when said keys have been mounted on said key support member, said movably-mounting means engages said keys with said key support member in a manner such that said keys are movable relative to said key support member.

Preferably, the movably-mounting means mounts the keys onto the key support member via the rear end portion of the each of the keys in a manner such that the keys can be moved in a direction in which the keys are juxtaposed by moving the rear end portion of the each of the keys.

Preferably, the movably-mounting means includes vertical position-limiting means for limiting a vertical position of the keys, and a longitudinal position-liming means for limiting a longitudinal position of the keys, the longitudinal position-limiting means including a reference surface formed on the key support member and extending in a direction in which the keys are juxtaposed, for determining a reference position for the longitudinal position of the keys, and an abutment surface formed on the keys, for abutting the reference surface when the keys are mounted on the key support member.

More preferably, the longitudinal position-limiting means includes urging means for bringing the abutment surface into slidable urging contact with the reference surface.

Preferably, the keyboard assembly includes guide means for guiding the keys into a position where the keys are mounted onto the key support member.

Preferably, the keys are preassembled into at least one key unit before being mounted on the key support member, the at least one key unit each having a common rear end portion including the rear end portion of the each of the keys, the abutment surface being formed on the common rear end portion.

More preferably, the key support member has a rear end portion having an upper surface, the urging means including protrusion means formed on the upper surface of the rear end portion of the key support member and extending in a direction in which the keys are juxtaposed, the protrusion means having the reference surface, at least one resilient piece formed on the common rear end portion of the at least one key unit in a fashion projecting downward, and at least one through hole formed through the rear end portion of the key support member at a location corresponding to the at least one resilient piece, the at least one resilient piece being inserted through the at least one through hole.

Further preferably, the rear end portion of the key support member has a lower surface, the at least one resilient piece each having a hook formed at a lower end thereof in a fashion projecting rearward, for engagement with the lower surface of the rear end portion of the key support member.

Further preferably, the protrusion means comprises a front protrusion and a rear protrusion formed at a front location and a rear location of the upper surface of the rear end portion of the key support member, respectively, the front protrusion having a rear surface and the rear protrusion having a front surface, the reference surface being formed by the rear surface of the front protrusion, the common rear end portion being fitted between the rear surface of the front protrusion and the front surface of the rear protrusion.

Even more preferably, the common rear end portion has a front lower end and a rear lower end, the guide means comprising a front guide member and a rear guide member formed respectively in line with the front protrusion and the rear protrusion, the front guide member and the rear guide member having inclined upper portions on respective sides thereof opposed to each other, for abutment with the front lower end and the rear lower end of the of the common rear end portion when the at least one key unit is mounted on the key support member.

Still more preferably, the front guide member has a rear lower edge flush with the reference surface of the front protrusion, and the rear guide member has a front lower edge portion flush with the front surface of the rear protrusion.

To attain the second and third objects, according to a second aspect of the invention, there is provided a keyboard assembly comprising a plurality of keys, a key support member for pivotally supporting the keys, the key support member having a main body, a plurality of key depression-detecting means each arranged on the key support member, for detecting a depression of a corresponding one of the keys, each of the key depression-detecting means having a resilient expanded portion, an actuator formed on each of the keys, for depressing the resilient expanded portion of a corresponding one of the key depression-detecting means, a keyslip provided on the main body of the key support member, and a ridge formed on the keyslip and extending in a direction in which the keys are juxtaposed, for slidably supporting the keys when the keys are mounted onto the key support member.

Preferably, the keys are preassembled into key units, each formed of a laminate of white keys and black keys, before being mounted onto the key support member.

To attain the second and third aspects, according to a third aspect of the invention, there is provided a keyboard assembly comprising a plurality of keys, a key support member for pivotally supporting the keys, a plurality of key depression-detecting means each arranged on the key support member, for detecting a depression of a corresponding one of the keys, each of the key depression-detecting means having a resilient expanded portion, an actuator formed on each of said keys, for depressing the resilient expanded portion of a corresponding one of the key depression-detecting means, at least one first guide rib formed on the key support member at a location opposed to a corresponding portion of at least one of the keys, for guiding the at least one of the keys when the keys are slid rearward to be mounted onto the key support member, and a recess formed in each of the corresponding portion of the at least one of the keys, for receiving a corresponding one of the at least one first guide rib after completion of mounting of the keys onto the key support member.

Preferably, the keyboard assembly includes at least one second guide rib formed on the key support member at a location opposed to a corresponding second portion of the at least one of the keys, for limiting a position of the each of the keys in a direction in which the keys are juxtaposed to a range within which the first guide rib can be received into the recess when the keys are slid rearward.

Preferably, the keys are preassembled into at least one key unit, each formed of a laminate of white keys and black keys, before being mounted onto the key support member, the recess being formed in each of the black keys.

Preferably, the keyboard assembly includes a ridge formed on the key slip and extending in a direction in which the keys are juxtaposed, for slidably supporting the keys when the keys are mounted onto the key support member.

To attain the first to third objects of the invention, according to a fourth aspect of the invention, there in provided a keyboard assembly comprising a plurality of keys, each of the keys including a body, a hinge portion, and a rear end portion, a key support member for pivotally supporting the keys, the key support member having a main body, a plurality of key depression-detecting means each arranged on the key support member, for detecting a depression of a corresponding one of the keys, each of the key depression-detecting means having a resilient expanded portion, an actuator formed on each of the keys, for depressing the resilient expanded portion of a corresponding one of the key depression-detecting means, a keyslip provided on the main body of the key support member, a ridge formed on the keyslip and extending in a direction in which the keys are juxtaposed, for slidably supporting the keys when the keys are mounted onto the key support member via the rear end portion of the each of the keys, and movably-mounting means for mounting the keys onto the key support member in a manner such that the keys can be moved by moving the rear end portion of the each of the keys, wherein when the keys are mounted onto the key support member, the keys are moved into a predetermined position by sliding the keys on the ridge, to be mounted onto the key support member, and when the keys have been mounted on the key support member, the movably-mounting means engages the keys with the key support member in a manner such that the keys are movable relative to the key support member.

To attain the first to third objects of the invention, according to a fifth aspect of the invention, there is provided a keyboard assembly comprising, a plurality of keys, a key support member for pivotally supporting the keys, a plurality of key depression-detecting means each arranged on the key support member, for detecting a depression of a corresponding one of the keys, each of the key depression-detecting means having a resilient expanded portion, an actuator formed on each of the keys, for depressing the resilient expanded portion of a corresponding one of the key depression-detecting means, at least one guide rib formed on the key support member at a location opposed to a corresponding portion of at least one of the keys, for guiding the at least one of the keys when the keys are slid rearward to be mounted onto the key support member, a recess formed in the corresponding portion of the at least one of the keys, for receiving a corresponding one of the at least one guide rib after completion of mounting of the keys onto the key support member, and movably-mounting means for mounting the keys onto the key support member in a manner such that the keys can be moved by moving the rear end portion of the each of the keys, wherein the movably-mounting means cooperates with the recess to engage the keys with the key support member in a manner such that the keys are movable relative to the key support member when the keys have been mounted on the key support member.

To attain the first to third objects of the invention, according to a sixth aspect of the invention, there is provided a method of assembling a keyboard assembly including a plurality of keys, each having a free front end portion having a lower surface, and a rear end portion, a key support member for pivotally supporting the keys, the key support member having a main body, a keyslip provided on the main body of the key support member, a ridge formed on the keyslip and extending in a direction in which the keys are juxtaposed, at least one guide rib formed on the key support member at a location opposed to a corresponding portion of at least one of the keys, a recess formed in the corresponding portion of the at least one of the keys, and movably-mounting means having vertical position-limiting means for limiting a vertical position of the keys, and a longitudinal position-limiting means for limiting a longitudinal position of the keys, the movably-mounting means permitting movement of the keys in the direction in which the keys are juxtaposed, within a limited range relative to the key support member, the method comprising a first step of placing the lower surface of the free front end portion of each of the keys in contact with the ridge, a second step of moving the keys relative to the key support member in a manner such that the guide rib is fitted into the recess, while allowing the lower surface of the free front end portion of the each of the keys to slide on the ridge, and a third step of mounting the keys onto the key support member via the rear end portion of the each of the keys in a manner such that the keys can be moved by moving the rear end portion of the each of the keys.

Preferably, the movably-mounting means includes at least one projection formed on one of at least one of the rear end portions of the keys and a corresponding portion of the key support member, and at least one hole formed in the other of the at least one of the rear end portions of the keys and the corresponding portion of the key support member at a location corresponding to the at least one hole, the at least one hole having such a size relative to a size of the at least one projection as permits movement of the keys in the direction in which the keys are juxtaposed, within the limited range relative to the key support member.

Further preferably, the movably-mounting means includes engaging means formed on the at least one projection for engagement with the at least one hole when the at least one projection is inserted through the at least one hole, the method including a fourth step of adjusting a position of the keys in the direction in which the keys are juxtaposed when the keys are mounted on the key support member while the engaging means engages with the at least one hole.

The above and other objects of the invention will become more apparent from the following detailed description taken in conjunction with the accompanying drawings.

DETAILED DESCRIPTION

The invention will now be described in detail with reference to drawings showing a preferred embodiment thereof.

Figure 1:
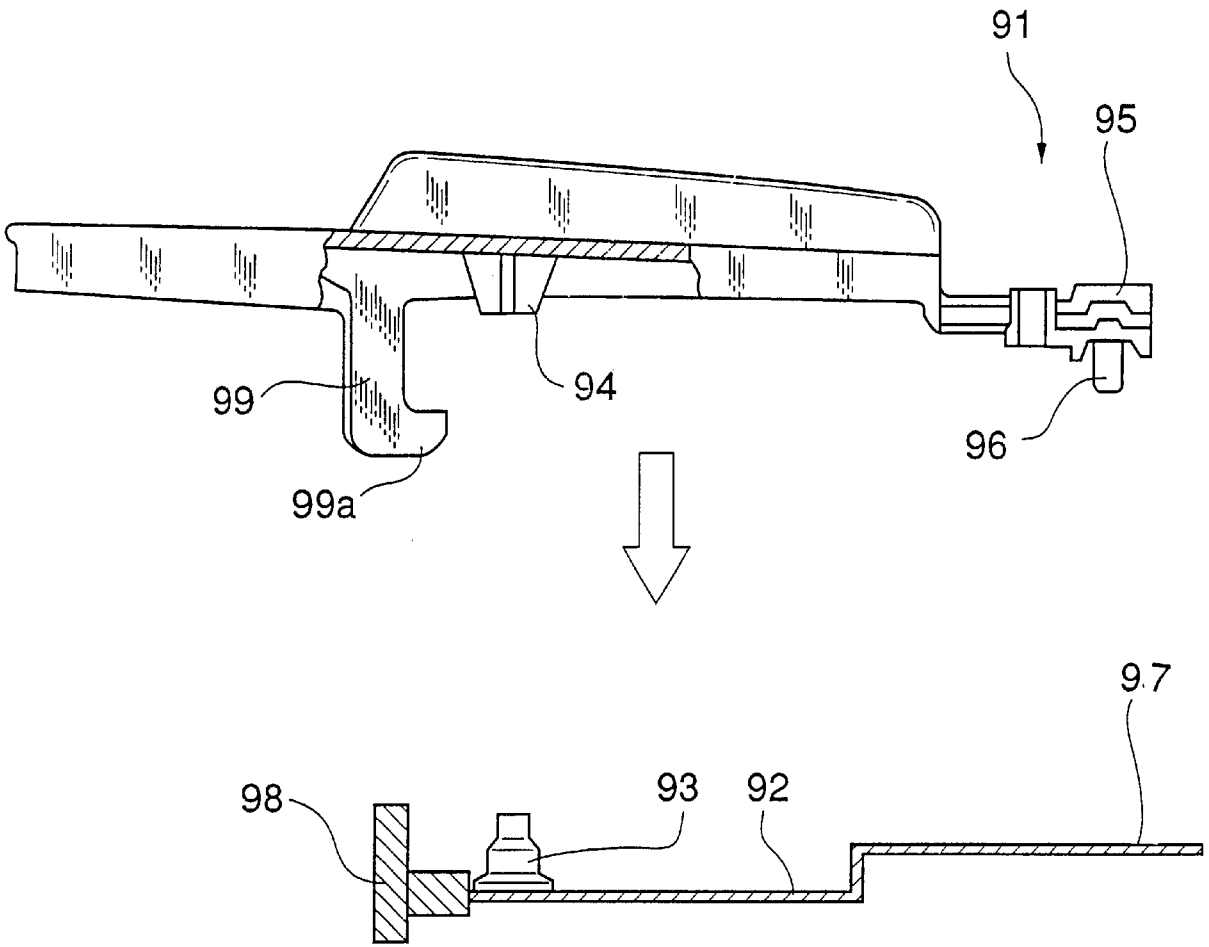
FIG.1 PRIOR ART
FIG. 1 is a vertical longitudinal cross-sectional view showing the construction of a conventional keyboard assembly.
Figure 2:
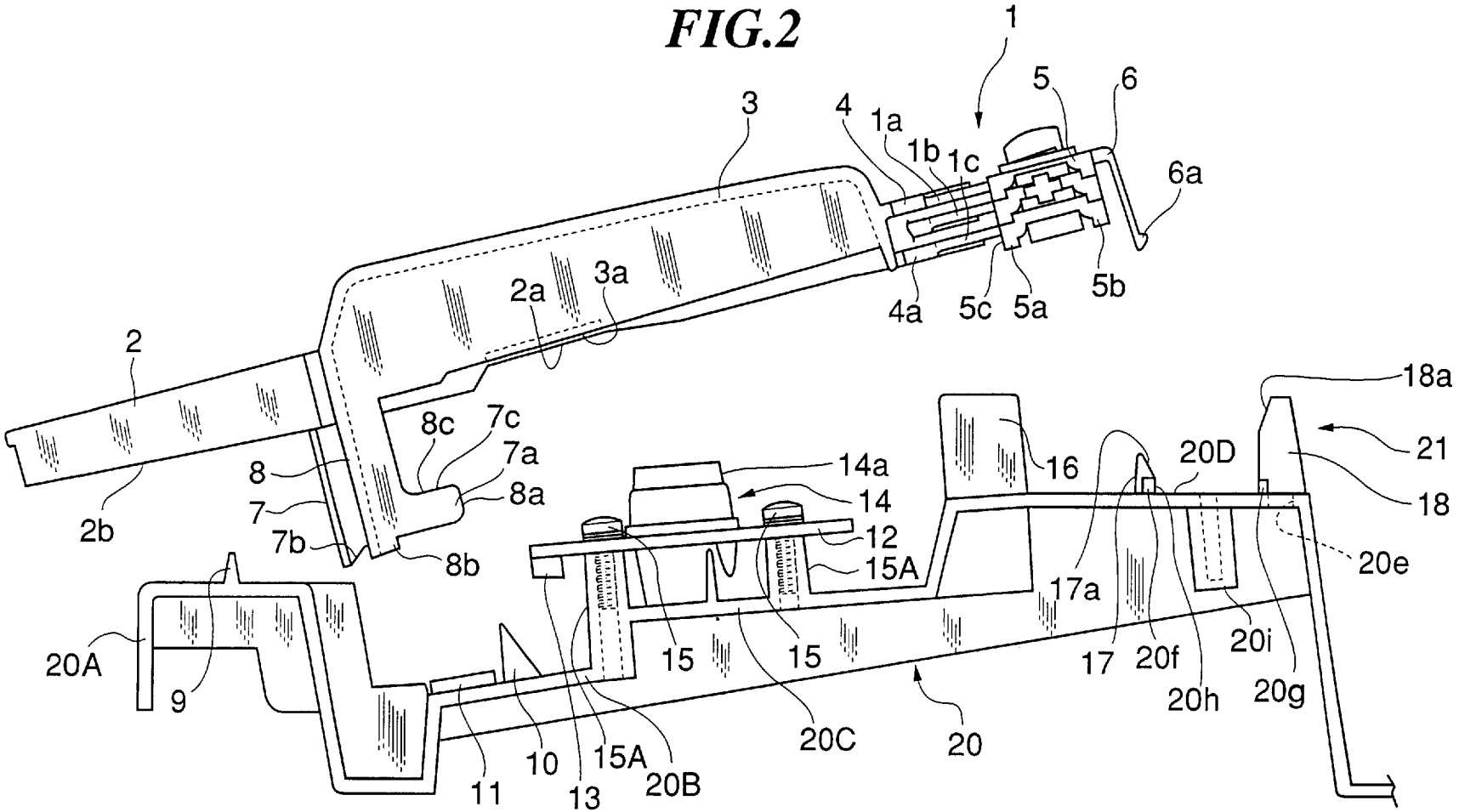
FIG. 2 is a vertical longitudinal cross-sectional view showing the construction of essential parts of a keyboard assembly according to an embodiment of the invention.
Figure 3:
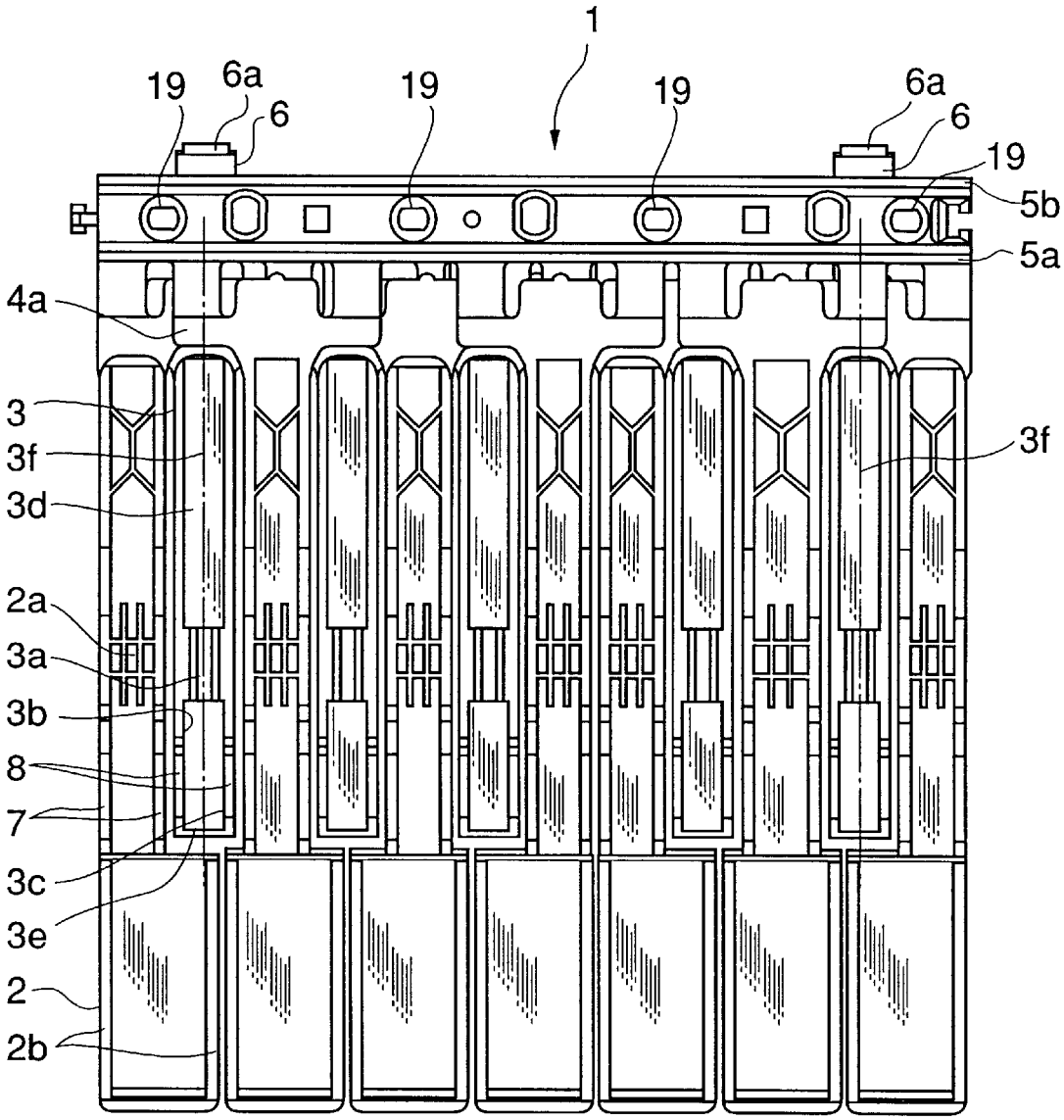
FIG. 3 is a plan view of a key unit appearing in FIG. 2, as viewed from a reverse side (underside) of the key unit.
Figure 4:
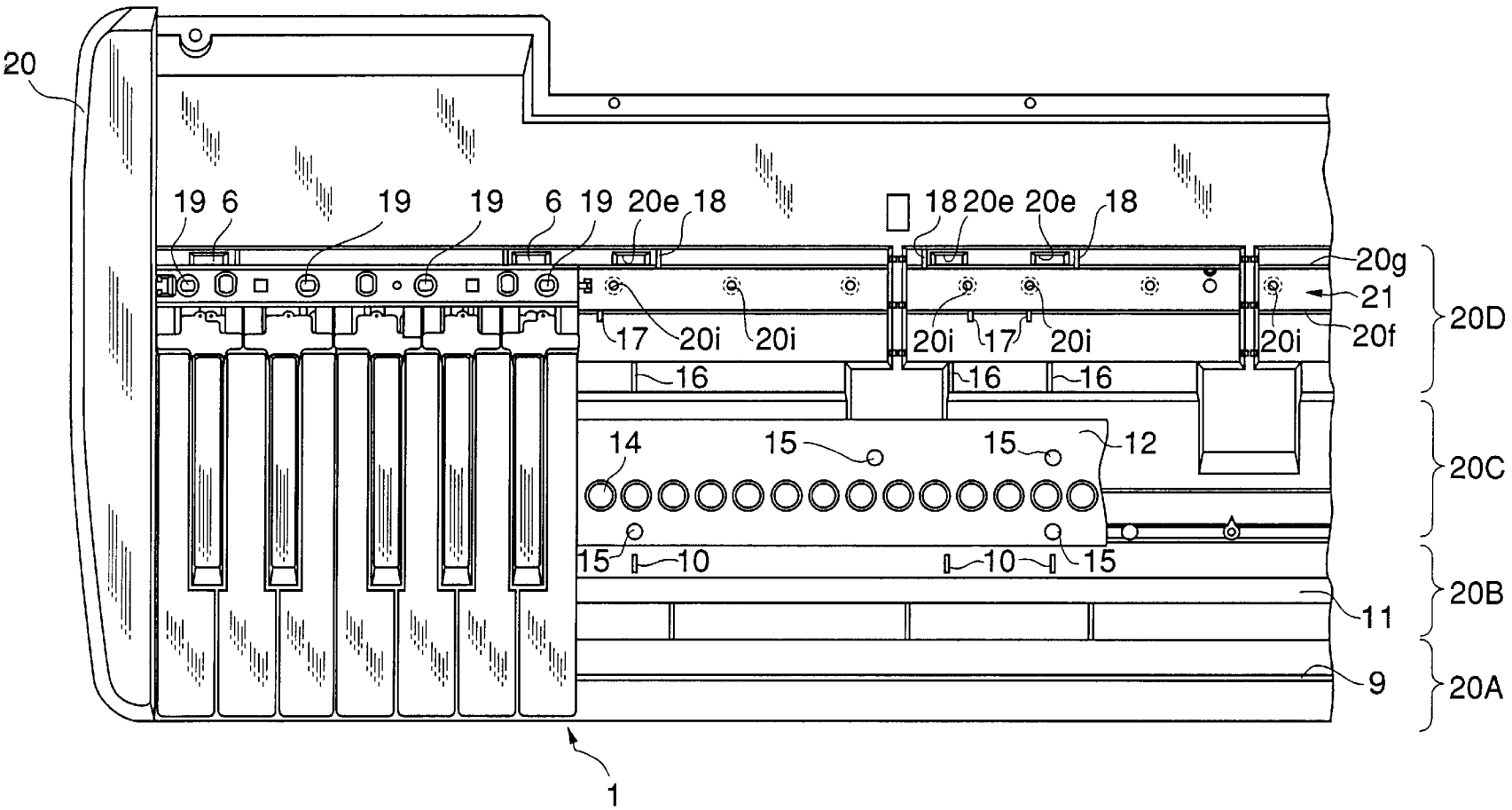
FIG. 4 is a plan view of a portion of a lower case of the keyboard assembly, as viewed from above, which extends from a left end of the lower case to a substantially central portion of the same, with a key unit corresponding to one octave of musical tones mounted in the left end of the lower case.

FIGS. 2 to 4 show the construction of a keyboard assembly according to an embodiment of the invention.

Figure 9:
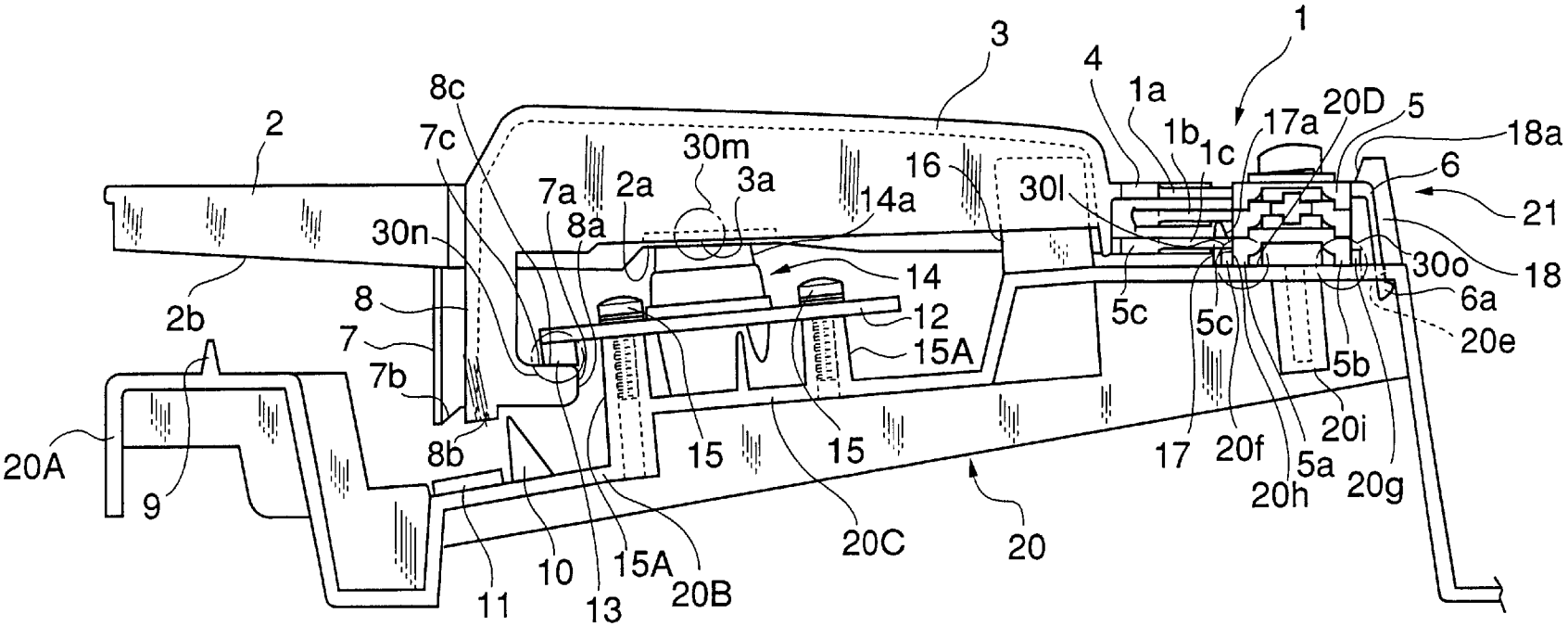
FIG. 9 is a vertical longitudinal cross-sectional view similar to FIG. 5, with the key unit having been mounted.

Referring first to FIG. 2, a keyboard assembly is shown in vertical longitudinal cross-section, which includes key units 1, a lower case 20 on which the key units 1 are mounted (the mounting of each key unit will be hereinafter referred to as "the key unit-mounting" as well), and an upper case, not shown, joined to the lower case 20. This figure shows one of the key units 1 and the lower case 20 in a state in which the key unit-mounting is about to be stated. A state of the key unit 1 and the lower case 20 after completion of the key unit-mounting is shown in FIG. 9, referred to hereinafter.

FIG. 3 is a plan view of the key unit 1, as viewed from a reverse side (underside) thereof. FIG. 4 is a plan view of a portion of the lower case 20 of the keyboard assembly extending from a left end to a substantially central portion thereof, as viewed from above, with one of the key units 1 corresponding to one octave of musical tones mounted in the left end thereof.

As shown in FIG. 2, each key unit 1 has a three-layered structure of a black key unit 1*a*, and two separate white key units 1*b*, 1*c*, each corresponding to one octave of musical tones, with respective rear end portions of the key units 1*a*, 1*b*, 1*c* laminated one upon another. The key unit 1 has white keys 2 and black keys 3 to be depressed, which are pivotally supported on a common rear end portion 5 in a manner vertically movable about respective hinge portions 4.

The lower case 20 has a keyslip 20A integrally formed on a front end thereof, which extends in a lateral direction i.e. a direction in which the keys are juxtaposed along the total width of the keys. The keyslip 20A has a ridge 9 formed integrally on the upper surface thereof such that it extends in the lateral direction along the total width of the keys, thereby serving as a reinforcement for the front end portion of the lower case 20. Further, the ridge 9 has its upper end brought into abutment with a front edge bottom 2*b* of each white key 2 when the key unit 1 is slid rearward (rightward as viewed in FIG. 2), to thereby slidably support the key unit 1 (particularly a front half portion thereof) via the front end bottom 2*b* of each white key 2.

The black keys 3 have follower portions (hereinafter referred to as "the black key follower portions") 8 formed integrally on respective bottoms thereof. Each black key 3 has two black key follower portions 8 formed thereon (see FIG. 3). Between the two black key follower portions 8, i.e. between an inner surface 3*b* of a right black key follower portion 8 of the black key 3 and an inner surface 3*c* of a left black key follower portion 8 of the same, there is formed a follower groove 3*e*. On the bottom of each white key 2, follower portions (hereinafter referred to as "the white key follower portions") 7 are similarly formed.

On the other hand, the lower case 20 has a depressed key stopper 11 formed on an upper surface of a front end portion 20B of the lower case 20. The depressed key stopper 11 extends in the lateral direction along the total width of the keys. When any of the white and black keys is depressed, a corresponding one of a lower end 7*b* of the white key follower portion 7 and a lower end 8*b* of the black key follower portion 8 is brought into abutment with the depressed key stopper 11, which thereby serves as a stopper.

The lower ends 7*b*, 8*b* of the black and white key follower portions 7, 8 have white key engaging ends 7*a* and black key engaging ends 8*a*, respectively, which are projected rearward therefrom. When the white and black keys are not depressed, the engaging ends 7*a*, 8*a* have upper surfaces 7*c*, 8*c* thereof disposed in contact with an upper limit stopper 13, referred to hereinafter.

Lateral guide ribs 10 are formed integrally on the lower case 20 in a fashion upwardly projecting from the upper surface of the front end portion 20B of the lower case at respective locations rearward of the depressed key stopper 11. Each lateral guide rib 10 is located such that it can be loosely inserted into the corresponding follower groove 3*e* when the key unit 1 is in a position assumed at the start of the key unit-mounting process (initial position shown in FIG. 5, referred to hereinafter), and at the same time it does not interfere with key-depressing operations by the player or operator.

More specifically, the lateral guide ribs 10 are arranged at locations corresponding to a key of a lowest pitch note (C#) and a key of a highest pitch note (A#) out of the five black keys 5 of each key unit 1, i.e. at locations in alignment with laterally central portions (indicated by one-dot-chain lines 3*f* shown in FIG. 3) of the follower grooves 3*e* formed in the respective black keys. Each lateral guide rib 10 prevents the key unit 1 from being laterally dislocated by abutting the inner surface 3*b* of the right black key follower portion 8 or the inner surface 3*c* of the left black key follower portion 8. It should be noted that although at least one lateral guide rib 10 is needed for each key unit 1, alternatively one lateral guide rib 10 may be provided for each of the black keys 3.

Each white key 2 has a white key actuator 2*a*, and each black key 3 has a black key actuator 3*a*. The white key actuator 2*a* is formed integrally on the white key 2 in a fashion protruding downward from the bottom surface of the white key 2 at a location rearward of the white key follower portion 7. The white key actuator 2*a* is in the form of parallel crosses (see FIG. 3) with a parallel cross-shaped bottom surface thereof flush with lower side surfaces of the white key 2. The black key actuator 3*a* is formed integrally on the black key 3 and has a flat bottom surface flush with lower side surfaces of the black key 3.

Since the key actuators 2*a*, 3*a* have a parallel-cross shape and a flat shape, respectively, instead of a projection, it is possible to secure the freedom of positioning key switches 14 with respect to respective resilient expanded portions 14*a*, as described hereinafter. Further, since the bottom surfaces of the key actuators 2*a*, 3*a* are flush with the lower side surfaces of the black and white keys 2, 3, respectively, the key unit 1 is hardly caught by the resilient expanded portions 14*a* when the key unit-mounting is carried out. This does not only facilitate mounting and removal of the key unit 1, but also reduces the possibility of formation of a so-called "molding sink" on the keys of the key unit 1 when they are formed from metal molds. It should be noted that the bottom surfaces of the key actuators 2*a*, 3*a* may be configured in any other shapes insofar as they are substantially flat.

The key switches 14 are arranged on a switch circuit board 12 provided in the lower case 20 at locations corresponding to the respective keys. The switch circuit board 12 is fixed to the lower case 20 by screws 15 threadedly fitted in bosses 15A formed at suitable locations on a central portion 20C of the lower case 20.

Each key switch 14 is arranged on the switch circuit board 12 via a rubber sheet, not shown, at a location which becomes opposed to the corresponding white key actuator 2*a* or black key actuator 3*a* after the key unit-mounting is completed. The resilient expanded portion 14*a* is mounted on the top of the key switch 14. The resilient expanded portion 14*a* is formed of a resilient material, such as rubber. The actuators 2*a*, 3*a* lightly contact the respective resilient expanded portions 14*a*. When the corresponding key is depressed, the resilient expanded portion 14*a* is deformed by the urging force of the actuator 2*a* or 3*a*. In the present embodiment, the key switch 14 detects a key-depressing operation by the player, based on contact between a movable contact and a fixed contact thereof, neither of which is shown. This is not limitative, however, and the key switch 14 may be implemented by a device using an optical sensor, such as a photo reflector.

In the present embodiment, the hinge portions 4 are of so-called "broad width type" as disclosed in Japanese Laid-Open Patent Publication (Kokai) No. 7-92963. More specifically, each hinge portion 4 of the key 2 or 3 is wider than the width of a rear end portion of the key 2 or 3 so that lateral opposite side portions thereof overlap part of the hinge portions of the adjacent keys. This makes it possible to depress the key without rolling or twisting thereof even if no key guide is provided therefor. Therefore, no key guide is provided in the present keyboard assembly. It should be noted that reference numeral 4*a* in several figures designates a lower hinge portion 4*a* provided for the white key unit 1*c*.

Each black key 3 has a bottom thereof formed with a recess 3*d* (see FIG. 3). The recess 3*d* extends from the rear end of the black key 3 to a rear end of the black key actuator 3*a*, and has a width equal to that of the follower groove 3*e*.

Longitudinal guide ribs 16 are formed integrally on the lower case 20 in a fashion protruding upward from the upper surface of a rear end portion 20D of the lower case 20. Each longitudinal guide rib 16 is arranged at such a location that it is kept in contact with the lower hinge portion 4*a* of the hinge portion 4 after the start of the key unit-mounting process until immediately before the termination of the same, and when the key unit 1 has been mounted, the longitudinal guide rib 16 has been received in the recess 3*d*.

More specifically, the longitudinal guide ribs 16 are arranged at locations corresponding to the respective lateral guide ribs 10 such that the longitudinal guide ribs 16 are substantially equal in number and width to the lateral guide ribs 10 and each longitudinal guide rib 16 is identical in lateral location to the corresponding lateral guide rib 10 (as indicated by the one-dot-chain lines 3*f* shown in FIG. 2). Each lateral guide rib 16 is longitudinally disposed (i.e. along the length of the white and black keys 2, 3) such that a rear end thereof is located forward of the rear end portion of the black key 3 when the key unit 1 has been mounted. The height of each longitudinal guide rib 16 is set to a range within which it does not interfere with the bottom surface of the black key 3. The longitudinal guide rib 16 has its top abut the lower hinge portion 4*a* when the key unit 1 is slid rearward for mounting the same, to slidably support the key unit 1 (particularly a rear half thereof) via the lower hinge portion 4*a*.

As described hereinafter, the longitudinal guide ribs 16 cooperate with the aforementioned ridge 9 to support the key unit 1 to thereby prevent the white and black key actuators 2*a*, 3*a* from abutting against the respective resilient expanded portions 14*a*. Further, the longitudinal guide ribs 16 and the ridge 9 suitably guide the key unit 1 into a key unit-mounting position in cooperation with the lateral guide ribs 10. Then, the longitudinal guide ribs 16 are received in the recesses 3*d* of the black keys 3 so as not to interfere with any key-depression operations of the player or operator.

In the present keyboard assembly, means (movably-mounting means) for mounting the key unit 1 on the lower case 20 through sliding of the same is constituted by vertical position-limiting means and longitudinal position-limiting means. The vertical position-limiting means is constituted by resilient portions 6, hooks 6*a*, catch holes 20*e*, all referred to hereinafter, and the rear end portion 20D of the lower case. The longitudinal position-limiting means is constituted by a reference surface 20*h*, an abutment surface 5*c*, and urging contact means, all referred to hereinafter. The urging contact means is constituted by a front rail 20*f*, a rear rail 20*g*, the resilient portions 6, and the catch holes 20*e*.

As described hereinafter, the rear end portion 20D of the lower case 20 serves to limit the vertical position of the key unit 1. Further, the longitudinal position-limiting means serves to limit the longitudinal position of the key unit 1 with the urging contact means holding the abutment surface 5*c* in urging contact with the reference surface 20*h*.

The abutment surface 5*c* is an end surface of a front lower end 5*a* of the common rear end portion 5, which is opposed to the reference surface 20*h*, to be brought into contact therewith.

The resilient portions 6 which are in the form of projections are provided at a rear end of the common rear end portion 5. The resilient portions 6 may be formed integrally on the black keys 3 and they protrude rearward from the rear end of the common rear end portion 5 in a fashion being bent downward. The resilient portions 6 each have a lateral center thereof arranged at a location on an imaginary line extending rearward from the corresponding lateral guide rib 10 (as indicated by the one-dot-chain lines 3*f*). The hook 6*a* is formed integrally on a lower end of each resilient piece 6 in a fashion protruding rearward therefrom.

The rear end portion 20D of the lower case has engaging means 21 which is constituted by the front rail 20*f*, the rear rail 20*g*, front guide stoppers 17, rear guide stoppers 18, and the catch holes 20*e* (see FIG. 4), referred to hereinafter. The lower case 20 supports the key unit 1 by the engaging means 21 via the common rear end portion 5.

The front-rail 20*f* and the rear rail 20*g*, which are in the form of a ridge, are formed integrally on the lower case 20 and extend on the rear end portion 20D of the lower case along the total width of all the keys. The front rail 20*f* is located forward of the rear rail 20*g*. The front rail 20*f* has its rear end brought into abutment with the abutment surface 5*c* of the common rear end portion 5 of the key unit 1 when the key unit-mounting is carried out. The rear end of the front rail 20*f* provides the reference surface 20*h* for setting the longitudinal position of the key unit After the key unit-mounting has been carried out, the front lower end 5*a* and a rear lower end 5*b* of the common rear end portion 5 abut the upper surface of the rear end portion 20D of the lower case 20 such that the common rear end portion 5 is fitted between the front rail 20*f* and the rear rail 20*g*. This makes it possible to easily set the vertical position of the common rear end portion 5 and the longitudinal position of the key unit 1. Further, the key unit 1 is placed on the top of the rear end portion 20D of the lower case via the common rear end portion 5 thereof such that the key unit 1 is longitudinally fixed in position, and at the same time laterally slidable as the common rear end portion 5 is laterally moved.

The common rear end portion 5 is fitted between the front rail 20*f* and the rear rail 20*g* with such a strength or force (fitting strength) that permits the common rear end portion 5 to laterally move. This increases the freedom of positioning the key unit 1 during the key unit-mounting. Further, the fitting strength is set to such a degree that each key can be depressed without practically causing any inconveniences even if screws are not used to fix the key unit 1 to the lower case 20. This can simplify the manufacturing process and reduce the number of component parts.

The front guide stoppers 17 and the rear guide stoppers 18 are each formed integrally on the lower case 20 in a fashion protruding upward from the rear end portion 20D of the lower case 20. The front guide stoppers 17 are located forward of the rear guide stoppers 18.

A rear lower edge portion of each front guide stopper 17 has a surface flush with a rear end surface (reference surface 20*h*) of the front rail 20*f*, and a rear upper edge portion of the front guide stopper 17, which is inclined backward, serves as a guide 17*a*. A front lower edge portion of each rear guide stopper 18 has a surface flush with a front end surface of the rear end rail 20*g*, and a front upper edge portion of the rear guide stopper 18, which is inclined forward, serves as a guide 18*a*.

When the common rear end portion 5 is lowered immediately before the key unit-mounting operation is completed, the guides 17*a* and the guides 18*a* abut the front lower end 5*a* and rear lower end 5*b* of the common rear end portion 5 to guide the common rear end portion 5 into a position suitable for fitting. Further, when the key unit 1 has been mounted, the front guide stoppers 17 play the role of a reinforcement against an external force applied to the key unit 1 in a forward direction, while the rear guide stoppers 18 play the role of a reinforcement against an external force applied to the same in a rearward direction.

Figure 2A:
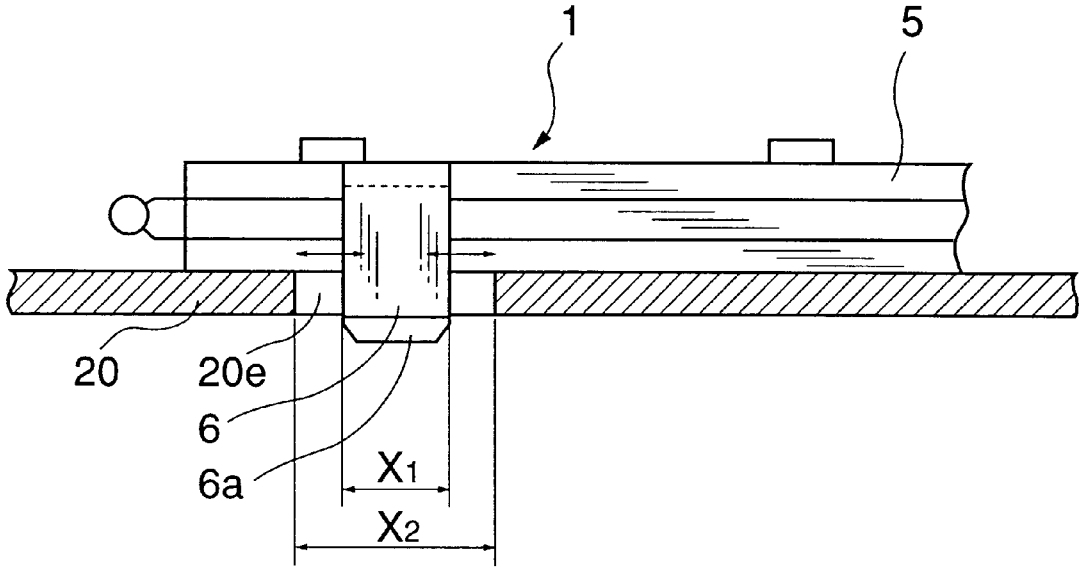
FIG. 2A is a vertical transverse cross-sectional view showing the construction of essential parts of the keyboard assembly.

The catch holes 20*e* are through holes formed in the upper surface of the rear end portion 20D at respective locations corresponding to the resilient portions 6. Each catch hole 20*e* has an opening with a suitable width (longitudinal length) which permits insertion of a corresponding one of the resilient portions 6 and at the same time permits the hook 6*a* to be engaged therein. Further, as shown in FIG. 2A, the opening of each catch hole 20*e* has a length (lateral length) X1 which has a slight error (several millimeters) in the lateral direction with respect to the width or lateral length X2 of the resilient piece 6, i.e. several millimeters larger than the latter. This permits movement of the key unit 1 in the lateral direction but within a limited range. More specifically, to prevent interference between each longitudinal guide rib 16 and the corresponding black key 3, it is preferred that the lateral clearance between the resilient portion 6 and the corresponding catch hole 20*e* should be set to a value smaller than the lateral clearance between the longitudinal guide rib 16 and the recess 3*d*.

Further, the common rear end portion 5 is formed therein with holes 19 each having an elliptical cross-section with its major axis extending in the lateral direction and a larger diameter or lateral size slightly larger than its minor axis (see FIG. 3). The rear end portion 20D of the lower case 20 has screw holes 20*i* formed therein at such locations that they are-opposed to the holes 19 when the key unit 1 has been mounted (FIG. 4). After the key unit 1 has been mounted, the common rear end portion 5 is fixed to the rear end portion 20D by fitting screws in the screw holes 20*i* to thereby limit the lateral motion of the key unit 1.

The keyboard assembly of the present embodiment is advantageous in respect of accuracy of mounting the key unit 1 on the lower case 20 in that there is freedom of positioning the key actuators 2*a*, 3*a*, with respect to the resilient expanded portions 14*a*, and the central portion 20C of the lower case 20 in which the key switches 14 are arranged and the rear end portion 20D of the same in which the common rear end portion 5 is arranged are integrally formed as components of the lower case 20. Therefore, it is possible to effect longitudinal positioning of the key unit 1 by the engaging means 21 alone. Further, by properly setting the strength or force of fitting the common rear end portion 5 in the engaging means 21, the keyboard assembly can be operated without practically causing any inconveniences and hence put to practical use, which can dispense with the use of screws to be fit into the screw holes 20*i* to fix the key unit 1 to the case 2. In short, the keyboard assembly can be regarded as a finished product in a state in which the key unit 1 is still movable in the lateral direction within a range in which the key actuators 2*a*, 3*a* can be brought into proper urging contact with the respective resilient expanded portions 14*a*.

However, it is preferable to secure the key unit 1 to the lower case 20 by screws using the screw holes 20*i* for safety in case of the keyboard assembly undergoing an unexpected external force caused e.g. by falling of the keyboard assembly or abnormal or improper handling of the same.

Next, the process of assembling the keyboard assembly of the present embodiment will be described with reference to FIGS. 5 to 9, as well as to FIGS. 2 to 4, if necessary.

FIGS. 5 to 9 show, in longitudinal cross-section, different states of the keyboard assembly according to the embodiment in the key unit-mounting process. In FIGS. 5 to 9, reference numerals 30*a* to 30*m* show contact points between the key unit 1 and the lower case 20.

Figure 5:
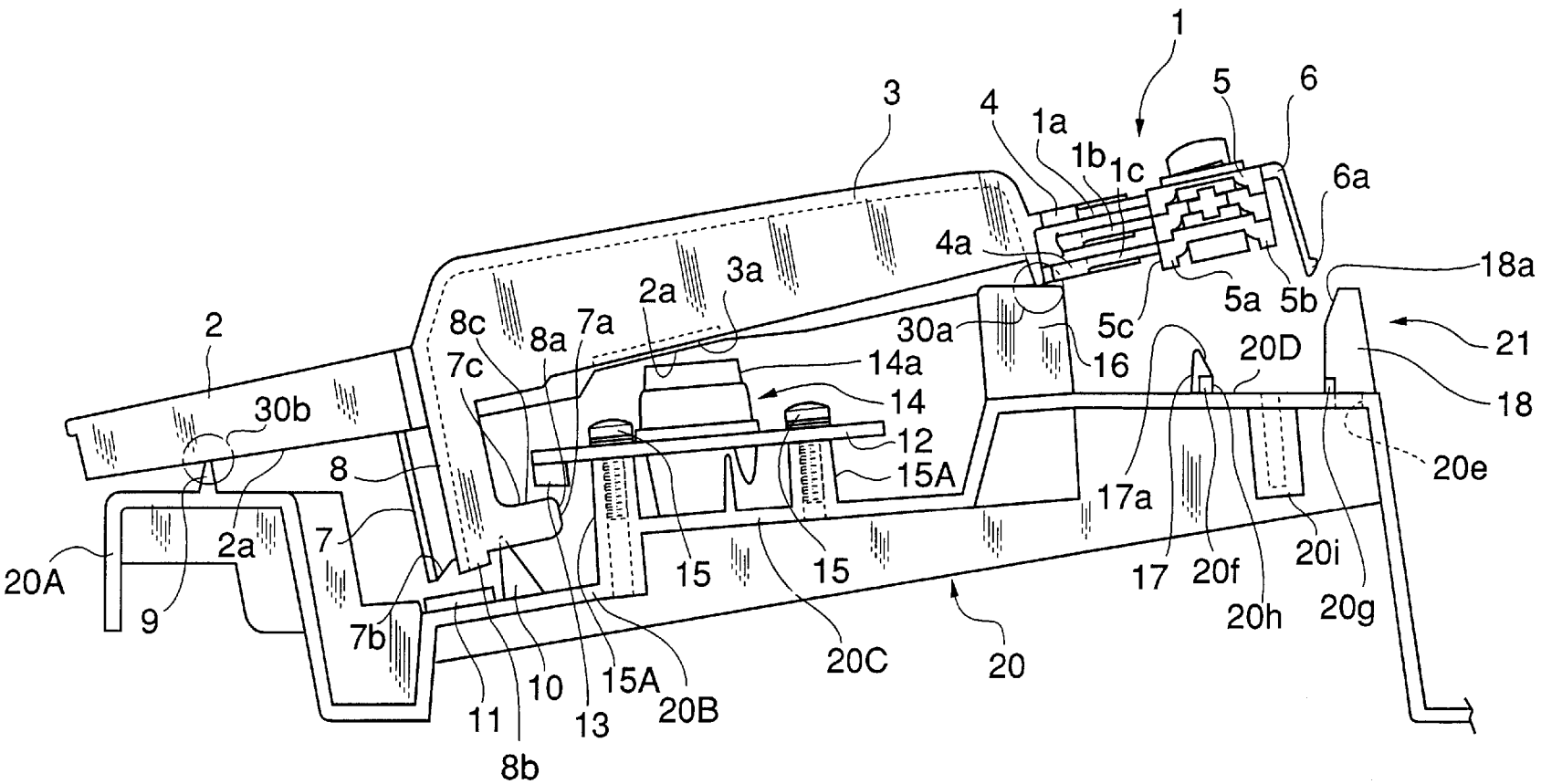
FIG. 5 is a vertical longitudinal cross-sectional view which is useful in explaining the process of mounting of a key unit, with the key unit being in an initial position.

First, the key unit 1 is placed by the worker on the lower case 20 in an initial position as shown FIG. 5. In doing this, the key unit 1 is adjusted in lateral position, i.e. aligned with the lower case 20 such that each lateral guide rib 10 properly fits in the follower groove 3*e* of the corresponding black key 3. At this time, the front end bottom 2*b* of each white key 2 is in contact with the upper end of the ridge 9 (contact point 30*b*), and at the same time a front lower end of the lower hinge portion 4*a* abuts the top of the lateral guide rib 16 (contact point 30*a*).

Since there is a clearance of several millimeters between each lateral guide rib 10 and the corresponding follower groove 3*e*, as mentioned above, it is possible to easily position the key unit 1 in the lateral direction. Further, if the key unit 1 is laterally dislocated when it is placed on the lower case 10, the lateral guide rib 10 is fit e.g. in the follower groove 3*e* of a black key 3 adjacent to the proper one, which makes the worker immediately notice the improper positioning of the key unit 1. As a result, the lateral position of the key unit 1 can be corrected at an early stage of the key unit-mounting process.

Figure 6:
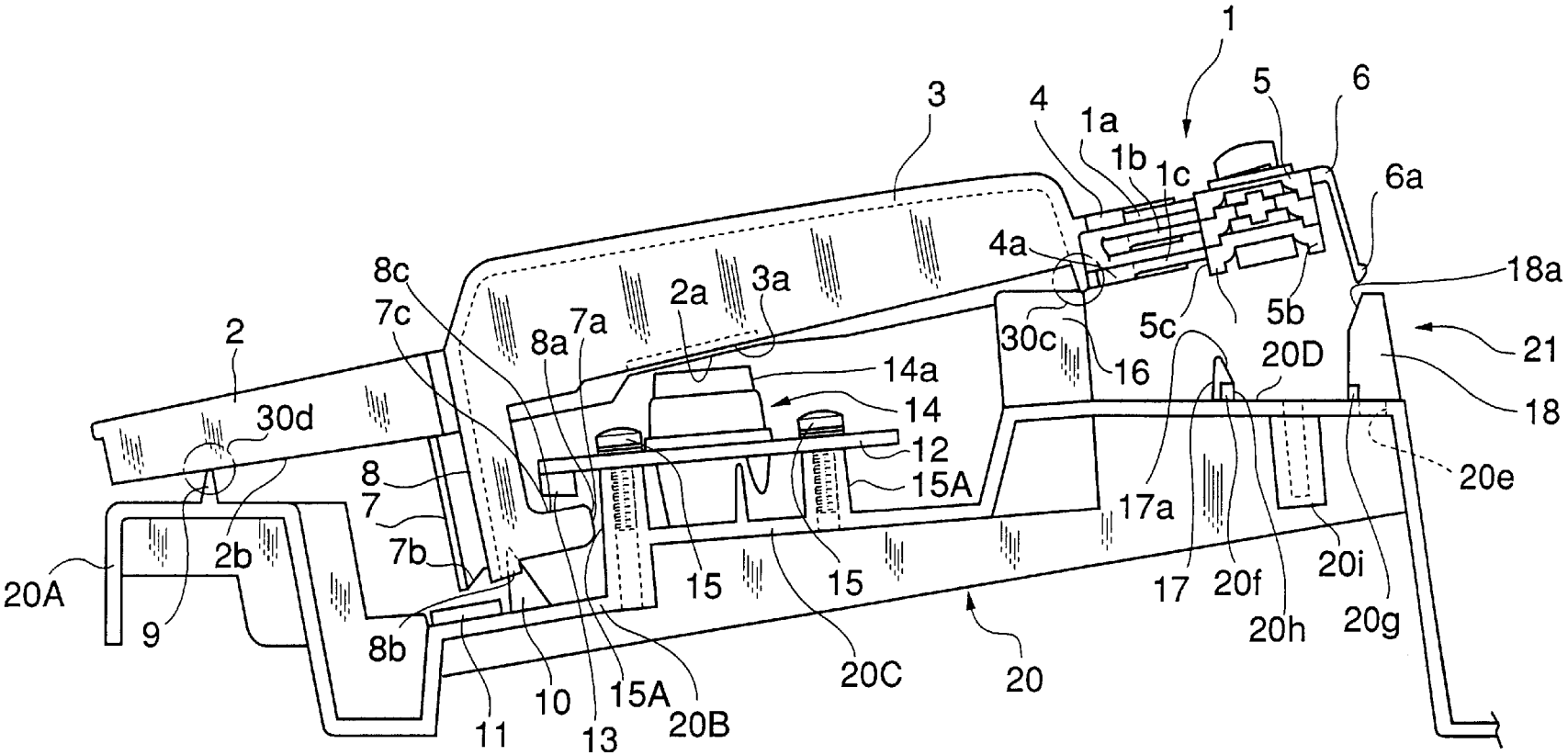
FIG. 6 is a vertical longitudinal cross-sectional view similar to FIG. 5, with the key unit being slid rearward.

Then, as the key unit 1 is moved rearward, as shown in FIG. 6, the front end bottom 2*b* of each white key 2 slides on the upper end of the ridge 9 (contact point 30*d*) and also the front lower end of the lower hinge portion 4*a* slides on the top of the longitudinal guide rib 16 (contact point 30*c*). During the process, even if the key unit 1 is laterally deviated in position, each lateral guide rib 10 abuts the inner surface 3*b* of the right black key follower portion 8 of the corresponding black key 3 or the inner surface 3*c* of the left black key follower portion piece 8 of the same whereby the lateral position of the key unit 1 is limited to a range within which each longitudinal guide rib 16 can be received in the corresponding recess 3*d* . Further, as the key unit 1 slides, the white key engaging ends 7*a* and black key engaging ends 8*a* are horizontally moved rearward below the upper limit stopper 13. At this time, the white key actuators 2*a* and the black key actuators 3*a* are not in contact with the resilient expanded portions 14*a* of the key switches 14.

Figure 7:
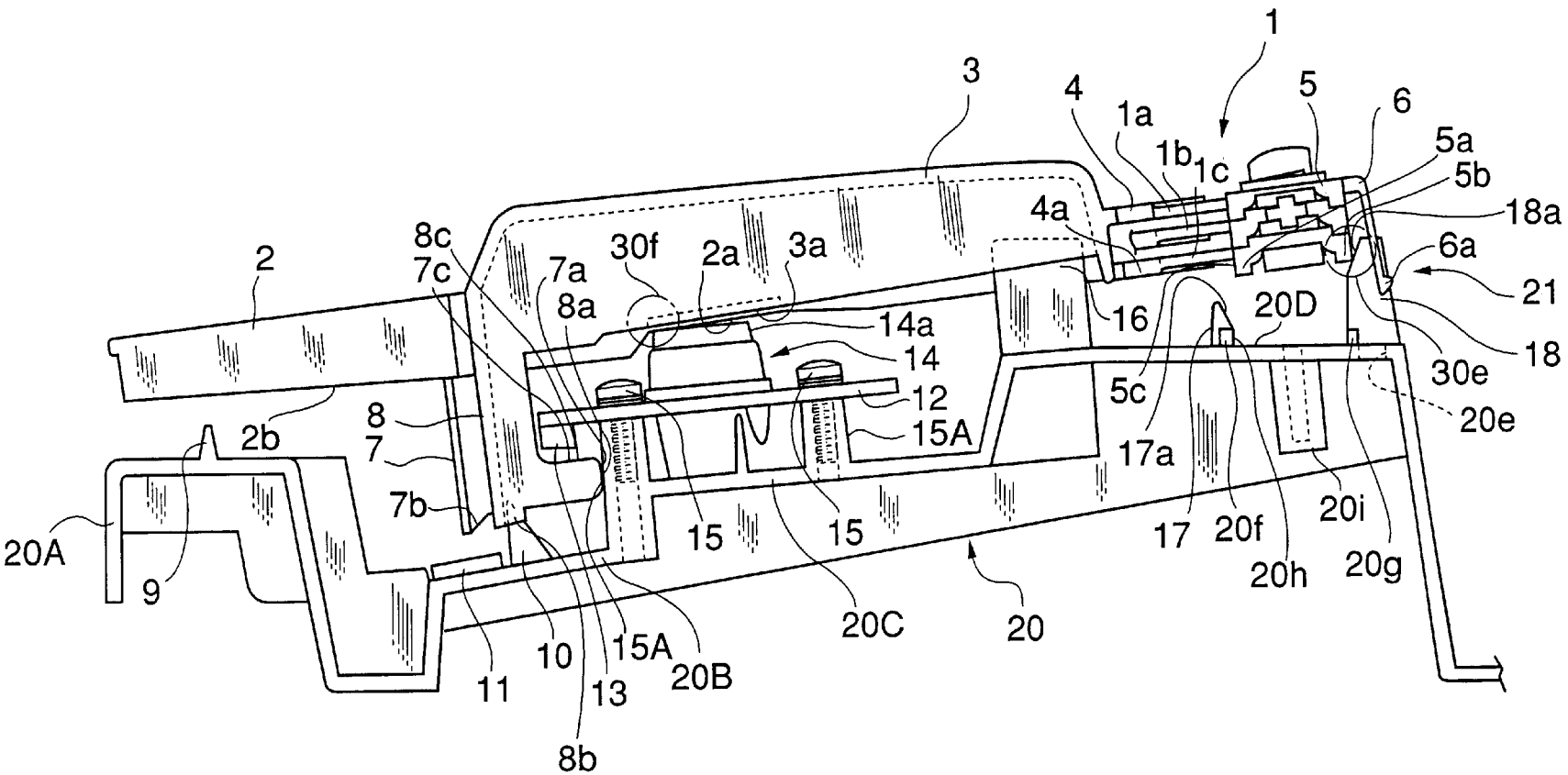
FIG. 7 is a vertical longitudinal cross-sectional view similar to FIG. 5, with the key unit starting to be lowered.

As the key unit 1 is further moved rearward to cause the front lower end of the lower hinge portion 4*a* to pass over a rear edge of the top of each longitudinal guide rib 16, the rear half of the key unit 1 lowers due to its own weight, as shown in FIG. 7. Accordingly, the key actuators 2*a*, 3*a* are brought into abutment with the resilient expanded portions 14*a* (contact point 30*f*). Then, the key unit 1 pivotally moves about the resilient expanded portions 14*a* in a manner falling rearward (rotating clockwise as viewed in the figure) due to imbalance in weight. As the key unit 1 undergoes rearward-falling pivotal motion, the front end bottom 2*b* of each white key 2 moves away from the ridge 9, and at the same time the rear lower end 5*b* of the common rear end portion 5 is brought into abutment with the guide portions 18*a* (contact point 30*e*) of the rear guide stoppers 18. As the process proceeds, each longitudinal guide rib 16 is brought into the recess 3*d* of the corresponding black key 3. This pivotal motion of the key unit 1 brings the key actuators 2*a*, 3*a* into contact with the resilient expanded portion 14*a* accurately from right above, which makes it possible to prevent the resilient expanded portions 14*a* from being peeled or deformed.

Then, when the common rear end portion 5 or its adjacent portion is depressed from above, the key unit 1 is pivotally moved about the resilient expanded portions 14*a* such that it further falls rearward. Accordingly, the common rear end portion 5 has its rear lower end 5*b* guided by the guide portions 18*a* of the rear guide stoppers 18 to be brought into contact with the rear rail 20*g* (contact point 30*h*), and at the same time the front lower end 5*a* is brought into abutment with the front rail 20*f* (contact point 30*k*). It should be noted that if a forward deviation of the key unit 1 occurs when the key unit 1 is pressed from above, the front lower end 5*a* is guided by the guides 17*a* into a position shown in FIG. 8, as well. The guides 17*a* and 18*a* guide the common rear end portion 5 into a proper fitting position with respect to the longitudinal direction.

Figure 8:
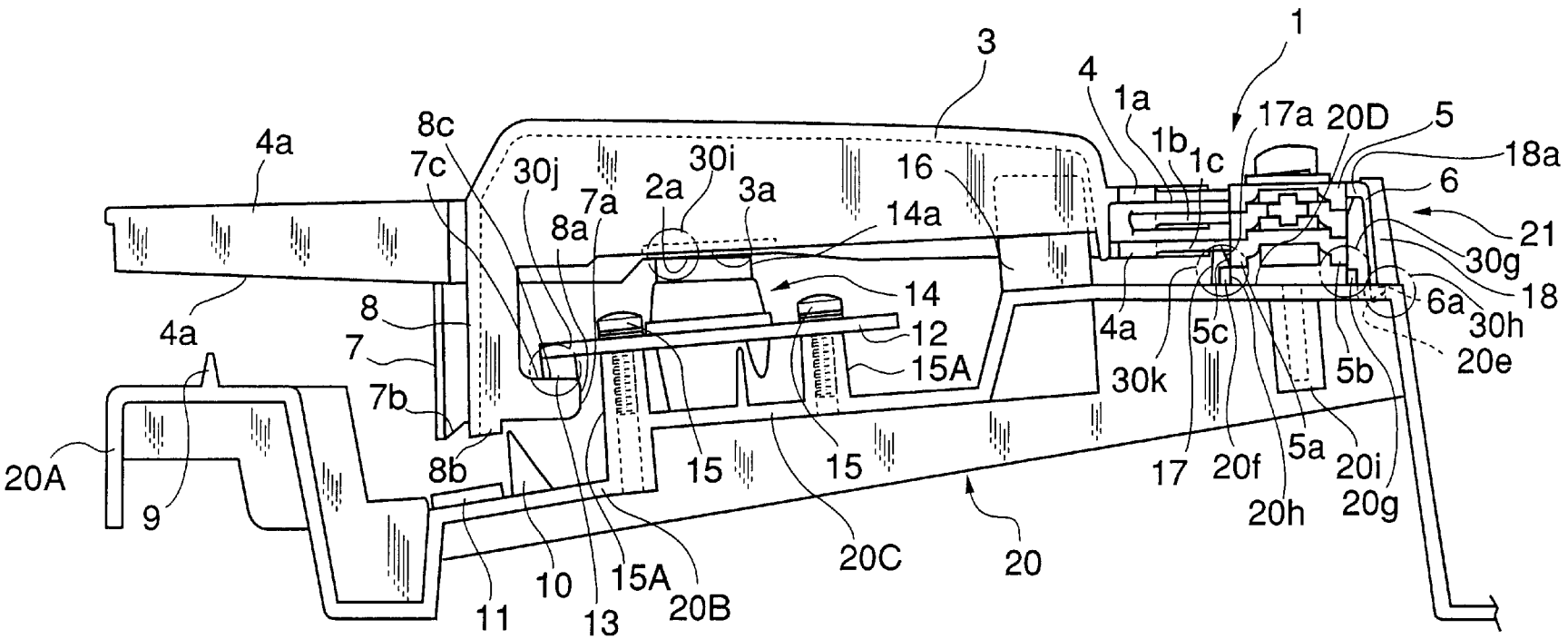
FIG. 8 is a vertical longitudinal cross-sectional view similar to FIG. 5, with the key having been lowered.

Further, with the pivotal movement of the key unit 1 caused by depressing of the common rear end portion 5 or its adjacent portion from above, the key engaging ends 7*a*, 8*a* move upward until the upper surfaces 7*c*, 8*c* of the engaging ends 7*a*, 8*a* are brought into abutment with the bottom of the upper limit stopper 13 (contact point 30*j*), as shown in FIG. 8, thereby setting an upper limit position of the keys 2, 3 assumed when they are released. Further, this causes each resilient portion 6 to be provisionally inserted in the opening of the corresponding catch hole 20*e* (contact point 30*h*). At this time, the key actuators 2*a*, 3*a* are still in contact with the respective resilient expanded portions 14*a*.

When the common rear end portion 5 or its adjacent portion is depressed further downward from above, as shown in FIG. 9, the front lower end 5*a* and the rear lower end 5*b* are brought into abutment with the top of the rear end portion 20D of the lower case 20, and at the same time the common rear end portion 5 is fitted between the front guide stopper 17 and the rear guide stopper 18. At the same time the resilient portions 6 are inserted into the respective catch holes 20*e* whereby the hooks 6*a* are engaged with the respective catch holes 20*e*. This limits the longitudinal position of the key unit 1 and the vertical position of the common rear end portion 5. At this time, the key actuators 2*a*, 3*a* abut the respective resilient expanded portions 14*a* such that each pair of opposed contact surfaces thereof are substantially parallel with each other (contact point 30*m*). The upper surfaces 7*c*, 8*c* of the engaging ends 7*a*, 8*a* remain in contact with the bottom of the upper limit stopper 13 (contact point 30*n*).

At this time, the rear surface of the rear lower end 5*b* abuts the front surface of the rear rail 20*g* (contact point 30*o*). Further, the common rear end potion 5 is urged forward by the resilient forces of the resilient portions 6 and the reaction forces from the rear rail 20*g*, so that the abutment surface 5*c* of the common rear end portion 5 is in urging contact with the reference surface 20*h* of the front rail 20*f* (contact point 301). Accordingly, the reference surface 20*h* of the front rail 20*f* serves as the true reference surface for setting the longitudinal position of the key unit 1. Therefore, to set the longitudinal position of the key unit 1, it is not essentially required to provide both of the rear rail 20*g* and the resilient portions 6, but provision of only one of them is sufficient.

Then, the key unit 1 is laterally slid along the front rail 20*f* and the rear rail 20*g*, whereby the key unit 1 is brought into a proper lateral position. When a plurality of key units 1 are used as in the present embodiment, this operation may be carried out after all the key units 1 are mounted onto the lower case 20. After the lateral position of the key unit 1 is set, screws, not shown, are fitted through the holes 19 into the screw holes 20*i*, whereby the mounting of the key unit 1 on the lower casing 20 is completed.

It should be noted that to remove the key unit 1 from the lower case 20, the hooks 6*a* are pushed from the rear side to disengage the same from the respective catch holes 20*e*, and then the above-mentioned mounting procedure is carried out in the order reverse to that described above. Since the keyboard assembly of the present embodiment is not provided with key guides, it is possible to remove the key unit 1 very easily.

According to the present embodiment, when the key unit 1 is mounted onto the lower case 20, the ridge 9 is used to support the key unit 1. Therefore, compared with the prior art in which the key unit 1 is supported by the key guides, the key unit 1 can be supported in a stabler manner, which makes it easier to mount the key unit 1 onto the lower case 20. Since the ridge 9 is simple in construction, and at the same time serves to reinforce the keyboard assembly, the manufacturing cost can be reduced. Further, since it is not required to provide a separate additional member on any white key 2 itself, on which the ridge 9 is to abut, the construction of the keyboard assembly can be simplified and the manufacturing cost thereof can be reduced, and further the possibility of formation of a so-called "molding sink" on the key unit 1 is reduced when the keys of the key unit 1 are made from metal molds. Further, the ridge 9 does not form an obstacle to the removal of the key unit 1. Furthermore, by setting the ridge 9 to a suitable height, the ridge 9 can serve as a lower limit stopper for the white keys 2 when they are depressed by the player with the strongest force. Therefore, the hinge portions 4 can be protected from damage and the depression key stopper 11 can be formed into a thinner shape.

Further, the provision of the lateral guide ribs 10 enables the longitudinal guide ribs 16 to be positively or reliably received in the recesses 3*d* of the black keys 3. Since each lateral guide rib 10 has a clearance with respect to the follower groove 3*e*, the initial position of the key unit 1 can be more easily set, compared with the prior art in which the lateral position of the key unit 1 is limited by the key guides. Further, the lateral guide ribs 10 do not form obstacles to removal of the key unit 1.

By virtue of cooperation of the lateral guide ribs 16 with the ridge 9, immediately before the key unit-mounting process is finished, the key actuators 2*a*, 3*a* are brought into contact with the respective resilient expanded portions 14*a* accurately from right above, which prevents the resilient expanded portions from being peeled or deformed, whereby the reliability of functioning of the key switches 14 can be secured. Further, when the key unit 1 has been mounted on the lower case 20, the lateral guide ribs 16 have been received within the respective recesses 3*d* of the black keys 3, which prevents formation of a dead space after the key unit 1 has been mounted, to thereby secure the mounting space for other component parts, and exert no adverse effects on the appearance of the keyboard assembly. Particularly, an increase in the thickness of the keyboard assembly can be prevented.

During the key unit-mounting process, the front lower end of each lower hinge portion 4*a* is brought into abutment with the corresponding longitudinal guide rib 16. Therefore, it is not required to provide a separate additional member on the key unit 1, on which the abutting each lateral guide rib 16 is to abut. Moreover, the present embodiment utilizes the recesses 3*d*, which are conventionally provided in the black keys 3, which makes the construction very simple and reduces the manufacturing cost. Furthermore, the lateral guide ribs 16 are loosely fitted in the respective recesses 3*d*, and hence constitute no obstacles to key-depression operations and removal of the key unit 1. Further, compared with the prior art in which support members corresponding to the lateral guide ribs 16 are provided on the key unit 1 side, it is possible to handle the key unit 1 more easily.

As is distinct from the prior art, the key actuators 2*a*, 3*a* and the resilient expanded portions 14*a* are not used as reference means for provisionally positioning the key unit 1, but the longitudinal position of the key unit 1 is set by the front rail 20*f*. This facilitates setting the longitudinal position of the key unit 1. Further, before the key unit 1 is secured to the lower case 20 by screws screwed into the screw holes 20*i*, it is possible to freely move the key unit 1 in the lateral direction while preserving the proper longitudinal position of the key unit 1. Therefore, in securing the key unit 1 to the lower case 20 by screws, the freedom of lateral movement of the key unit 1 can be obtained, which accommodates the manufacturing tolerances or errors of the key unit 1 and the lower case 20. Therefore, it is possible to prevent degradation of the productivity due to repeated key unit-mounting operations, and an increase in the manufacturing cost due to a lowered yield caused when key units 1 are judged to be defective. In addition, if the key unit 1 is not secured to the lower case 20 by screws, it is possible to simplify the manufacturing process and reduce the number of component parts.

As described heretofore, according to the present embodiment, facilitation of the mounting operation of the key unit 1 on the lower case 20 and space saving can be realized with a low manufacturing cost and a simple construction, while maintaining the ease of handling the key unit during the key-mounting process, and further avoiding degradation of a key touch sensed when any of the keys is depressed, as well as peeling or deformation of the resilient expanded portions 14*a*.

All or part of the ridge 9, lateral guide ribs 10, longitudinal guide ribs 16, front guide stoppers 17, rear guide stoppers 18, front rail 20*f* and rear rail 20*g* may be fabricated in separate pieces from the lower case 20.

The configuration of the ridge 9 is not limited to the illustrated one, but it may have any other shape, such as a rectangular shape, insofar as it serves as both a guide for the key unit 1 and a reinforcement for the keyslip 20A.

Although in the above described embodiment, as the recess 3*d* for receiving the longitudinal guide rib 16, one formed in the black key 3 is used, this is not limitative, but a recess formed in the white key 2 may be used as the recess 3*d*.

Although in the above described embodiment, the resilient portions 6 are provided on the common rear end portion 5, this is not limitative, but they may be formed on the lower case 20, and respective corresponding catch holes 20*e* may be formed in the common rear end portion 5. Further, the resilient portions 6 may be formed on a front portion of the common rear end portion 5 or on a front portion of the lower case 20D.

Although in the above described embodiment, during the key unit-mounting process, the common rear end portion 5 is fitted between the front rail 20*f* and the rear rail 20*g*, this is not limitative, but the male and female fitting relation may be reversed, i.e. the common rear end portion 5 may be fitted over the front rail 20*f* and the rear rail 20*g*.

Although in the above described embodiment, no key guide is provided, key guides may be provided for prevention of lateral movement of the keys when they are depressed. In such a case, opposite lateral sides of each key guide may be used to serve as guides for the key unit 1 in the lateral direction used during the key unit-mounting process.

Although in the above described embodiment, key units each having a plurality of preassembled keys are used, this is not limitative, but the invention may be applied to a key unit having only one key, e.g. as disclosed in Japanese Patent Application No. 9-39481 filed by the assignee of the present application in which a key unit having only one key is provided in addition to key units having a normally used range (e.g. 60 keys), to generate a musical tone having a pitch higher than the normally used range, for example.

What is claimed is:

1. A keyboard assembly comprising:

a plurality of keys, each of said keys including a body, a hinge portion, and a rear end portion;

a key support member for pivotally supporting said keys; and movably-mounting means for mounting said keys onto said key support member via said rear end portion of said each of said keys in a manner such that said keys can be moved by moving said rear end portion of said each of said keys, wherein said movably-mounting means includes longitudinal position-limiting means for limiting a longitudinal position of said keys, and said longitudinal position-limiting means including a surface formed on said key support member and another surface formed on said keys, and wherein when said keys have been mounted on said key support member, said longitudinal position-limiting means engages said keys with said key support member in a manner such that said surface and said another surface allow said keys to be movable relative to said key support member in a direction in which said keys are juxtaposed.

2. A keyboard assembly according to claim 1, wherein said movably-mounting means further includes vertical position-limiting means for limiting a vertical position of said keys, said surface comprises a reference surface formed on said key support member and extending in a direction in which said keys a juxtaposed, for determining a reference position for said longitudinal of said keys, and said another surface comprises an abutment surface formed on said keys, for abutting said reference surface when said keys are mounted on said key support member.

3. A keyboard assembly according to claim 2, wherein said longitudinal position-limiting means includes urging means for bringing said abutment surface into slidable urging contact with said reference surface.

4. A keyboard assembly according to claim 2, wherein said keys are preassembled into at least one key unit before being mounted on said key support member, said at least one key unit each having a common rear end portion including said rear end portion of said each of said keys, said abutment surface being formed on said common rear end portion.

5. A keyboard assembly according to claim 3, wherein said key support member has a rear end portion having an upper surface, said urging means including protrusion means formed on said upper surface of said rear end portion of said key support member and extending in a direction in which said keys are juxtaposed, said protrusion means having said reference surface, at least one resilient portion projected form said common rear end portion of said at least one key unit in a fashion projecting downward, and at least one through hole formed through said rear end portion of said key support member at a location corresponding to said at least one resilient portion, said at least one resilient portion being inserted through said at least one through hole.

6. A keyboard assembly according to claim 5, wherein said rear end portion of said key support member has a lower surface, said at least one resilient portion each having a hook formed at a lower end thereof in a fashion projecting rearward, for engagement with said lower surface of said rear end portion of said key support member.

7. A keyboard assembly according to claim 5, wherein said protrusion means comprises a front protrusion and a rear protrusion formed at a front location and a rear location of said upper surface of said rear end portion of said key support member, respectively, said front protrusion having a rear surface and said rear protrusion having a front surface, said reference surface being formed by said rear surface of said front protrusion, said common rear end portion being fitted between said rear surface of said front protrusion and said front surface of said rear protrusion.

8. A keyboard assembly according to claim 7, wherein said common rear end portion has a front lower end and a rear lower end, said guide means comprising a front guide member and a rear guide member formed respectively in line with said front protrusion and said rear protrusion, said front guide member and said rear guide member having inclined upper portions on respective sides thereof opposed to each other, for abutment with said front lower end and said rear lower end of said of said common rear end portion when said at least one key unit is mounted on said key support member.

9. A keyboard assembly according to claim 8, wherein said front guide member has a rear lower edge flush with said reference surface of said front protrusion, and said rear guide member has a front lower edge portion flush with said front surface of said rear protrusion.

10. A keyboard assembly according to claim 1, including guide means for guiding said keys into a position where said keys are mounted onto said key support member.

11. A keyboard assembly comprising:

a plurality of keys;

a key support member for pivotally supporting said keys, said key support member having a main body;

a plurality of key depression-detecting means each arranged on said key support member, for detecting a depression of a corresponding one of said keys, each of said key depression-detecting means having a resilient expanded portion;

an actuator formed on each of said keys, for depressing said resilient expanded portion of a corresponding one of said key depression-detecting means;

a keyslip provided on said main body of said key support member; and a ridge formed on said keyslip and extending in a direction in which said keys are juxtaposed, for slidably supporting said keys when said keys are mounted onto said key support member.

12. A keyboard assembly according to claim 11, wherein said keys are preassembled into at least one key unit, each formed of a laminate of white keys and black keys, before being mounted onto said key support member.

13. A keyboard assembly comprising:

a plurality of keys;

a key support member for pivotally supporting said keys;

a plurality of key depression-detecting means each arranged on said key support member, for detecting a depression of a corresponding one of said keys, each of said key depression-detecting means having a resilient expanded portion;

an actuator formed on each of said keys, for depressing said resilient expanded portion of a corresponding one of said key depression-detecting means;

at least one first guide rib formed on said key support member at a location opposed to a corresponding portion of at least one of said keys, for guiding said at least one of said keys when said keys are slid rearward to be mounted onto said key support member; and a recess formed in said corresponding portion of said at least one of said keys, for receiving a corresponding one of said at least one first guide rib after completion of mounting of said keys onto said key support member.

14. A keyboard assembly according to claim 13, including at least one second guide rib formed on said key support member at a location opposed to a corresponding second portion of said at least one of said keys, for limiting a position of said each of said keys in a direction in which said keys are juxtaposed to a range within which said first guide rib can be received into said recess when said keys are slid rearward.

15. A keyboard assembly according to claim 13, wherein said keys are preassembled into at least one key unit, each formed of a laminate of white keys and black keys, before being mounted onto said key support member, said recess being formed in each of said black keys.

16. A keyboard assembly according to claim 13, including a ridge formed on said key slip and extending in a direction in which said keys are juxtaposed, for slidably supporting said keys when said keys are mounted onto said key support member.

17. A keyboard assembly comprising:

a plurality of keys, each of said keys including a body, a hinge portion, and a rear end portion;

a key support member for pivotally supporting said keys, said key support member having a main body;

a plurality of key depression-detecting means each arranged on said key support member, for detecting a depression of a corresponding one of said keys, each of said key depression-detecting means having a resilient expanded portion;

an actuator formed on each of said keys, for depressing said resilient expanded portion of a corresponding one of said key depression-detecting means;

a keyslip provided on said main body of said key support member;

a ridge formed on said keyslip and extending in a direction in which said keys are juxtaposed, for slidably supporting said keys when said keys are mounted onto said key support member via said rear end portion of said each of said keys; and movably-mounting means for mounting said keys onto said key support member in a manner such that said keys can be moved by moving said rear end portion of said each of said keys, wherein when said keys are mounted onto said key support member, said keys are moved into a predetermined position by sliding said keys on said ridge, to be mounted onto said key support member, and when said keys have been mounted on said key support, member, said movably-mounting means engages said keys with said key support member in a manner such that said keys are movable relative to said key support member.

18. A keyboard assembly comprising:

a plurality of keys;

a key support member for pivotally supporting said keys;

a plurality of key depression-detecting means each arranged on said key support member, for detecting a depression of a corresponding one of said keys, each of said key depression-detecting means having a resilient expanded portion;

an actuator formed on each of said keys, for depressing said resilient expanded portion of a corresponding one of said key depression-detecting means;

at least one guide rib formed on said key support member at a location opposed to a corresponding portion of at least one of said keys, for guiding said at least one of said keys when said keys are slid rearward to be mounted onto said key support member; and a recess formed in each of said corresponding portion of said at least one of said keys, for receiving a corresponding one of said at least one guide rib after completion of mounting of said keys onto said key support member;

movably-mounting means for mounting said keys onto said key support member in a manner such that said keys can be moved by moving said rear end portion of said each of said keys, wherein said movably-mounting means cooperates with said recess to engage said keys with said key support member in a manner such that said keys are movable relative to said key support member when said keys have been mounted on said key support member.

19. A method of assembling a keyboard assembly including a plurality of keys, each having a free front end portion having a lower surface, and a rear end portion, a key support member for pivotally supporting said keys, said key support member having a main body, a keyslip provided on said main body of said key support member, a ridge formed on said keyslip and extending in a direction in which said keys are juxtaposed, at least one guide rib formed on said key support member at a location opposed to a corresponding portion of at least one of said keys, a recess formed in said corresponding portion of said at least one of said keys, and movably-mounting means having vertical position-limiting means for limiting a vertical position of said keys, and a longitudinal position-limiting means for limiting a longitudinal position of said keys, said movably-mounting means permitting movement of said keys in said direction in which said keys are juxtaposed, within a limited range relative to said key support member, the method comprising:

a first step of placing said lower surface of said free front end portion of each of said keys in contact with said ridge;

a second step of moving said keys relative to said key support member in a manner such that said guide rib is fitted into said recess, while allowing said lower surface of said free front end portion of said each of said keys to slide on said ridge; and a third step of mounting said keys onto said key support member via said rear end portion of said each of said keys in a manner such that said keys can be moved by moving said rear end portion of said each of said keys.

20. A method according to claim 19, wherein said movably-mounting means includes at least one projection formed on one of at least one of said rear end portions of said keys and a corresponding portion of said key support member, and at least one hole formed in the other of said at least one of said rear end portions of said keys and said corresponding portion of said key support member at a location corresponding to said at least one hole, said at least one hole having such a size relative to a size of said at least one projection as permits movement of said keys in said direction in which said keys are juxtaposed, within said limited range relative to said key support member.

21. A method according to claim 20, wherein said movably-mounting means includes engaging means formed on said at least one projection for engagement with said at least one hole when said at least one projection is inserted through said at least one hole, the method including a fourth step of adjusting a position of said keys in said direction in which said keys are juxtaposed when said keys are mounted on said key support member while said engaging means engages with said at least one hole.

22. A keyboard assembly comprising:

a plurality of keys, each of said keys including a body, a hinge portion, and a rear end portion;

a key support member for pivotally supporting said keys; and movably-mounting means for mounting said keys onto said key support member via said rear end portion of said each of said keys in a manner such that said keys can be moved by moving said rear end portion of said each of said keys, wherein when said keys have been mounted on said key support member, said movably-mounting means engages said keys with said key support member in a manner such that said keys are movable relative to said key support member, and wherein said movably-mounting means includes vertical position-limiting means for limiting a vertical position of said keys, and a longitudinal position-limiting means for limiting a longitudinal position of said keys, said longitudinal position-limiting means including:

a reference surface formed on said key support member and extending in a direction in which said keys are juxtaposed, for determining a reference position for said longitudinal position of said keys; and an abutment surface formed on said keys, for abutting said reference surface when said keys are mounted on said key support member.

23. A keyboard assembly comprising:

a plurality of keys, each of said keys including a body, a hinge portion, and a rear end portion;

a key support member for pivotally supporting said keys; and movably-mounting means for mounting said keys onto said key support member via said rear end portion of said each of said keys in a manner such that said keys can be moved by moving said rear end portion of said each of said keys, wherein when said keys have been mounted on said key support member, said movably-mounting means engages said keys with said key support member in a manner such that said keys are movable relative to said key support member, wherein said movably-mounting means includes vertical position-limiting means for limiting a vertical position of said keys, and a longitudinal position-limiting means for limiting a longitudinal position of said keys, said longitudinal position-limiting means including:

a reference surface formed on said key support member and extending in a direction in which said keys are juxtaposed, for determining a reference position for said longitudinal position of said keys; and an abutment surface formed on said keys, for abutting said reference surface when said keys are mounted on said key support member, and wherein said longitudinal position-limiting means including urging means for bringing said abutment surface into slidable urging contact with said reference surface.

24. A keyboard assembly comprising:

a plurality of keys, each of said keys including a body, a hinge portion, and a rear end portion;

a key support member for pivotally supporting said keys; and movably-mounting means for mounting said keys onto said key support member via said rear end portion of said each of said keys in a manner such that said keys can be moved by moving said rear end portion of said each of said keys, wherein when said keys have been mounted on said key support member, said movably-mounting means engages said keys with said key support member in a manner such that said keys are movable relative to said key support member, wherein said movably-mounting means includes vertical position-limiting means for limiting a vertical position of said keys, and a longitudinal position-limiting means for limiting a longitudinal position of said keys, said longitudinal position-limiting means including:

a reference surface formed on said key support member and extending in a direction in which said keys are juxtaposed, for determining a reference position for said longitudinal position of said keys; and an abutment surface formed on said keys, for abutting said reference surface when said keys are mounted on said key support member, wherein said longitudinal position-limiting means including urging means for bringing said abutment surface into slidable urging contact with said reference surface, and wherein said key support member has a rear end portion having an upper surface, said urging means including protrusion means formed on said upper surface of said read end portion of said key support member and extending in a direction in which said keys are juxtaposed, said protrusion means having said reference surface, at least one resilient portion projected form said common rear end portion of said at least one key unit in a fashion projecting downward, and at least one through hole formed through said rear end portion of said key support member at a location corresponding to said at least one resilient portion, said at least one resilient portion being inserted through said at least one through hole.

25. The keyboard assembly according to claim 24, wherein said rear end portion of said key support member has a lower surface, said at least one resilient portion each having a hook formed at a lower end thereof in a fashion projecting rearward, for engagement with said lower surface of said rear end portion of said key support member.

26. The keyboard assembly according to claim 24, wherein said protrusion means comprises a front protrusion and a rear protrusion formed at front location and a rear location of said upper surface of said rear end portion of said key support member, respectively, said front protrusion having a rear surface and said rear protrusion having a front surface, said reference surface being formed by said rear surface of said front protrusion, said common rear end portion being fitted between said rear surface of said front protrusion and said front surface of said rear protrusion.

27. The keyboard assembly according to claim 26, wherein said common rear end portion has a front lower end and a rear lower end, said guide means comprising a front guide member and a rear guide member formed respectively in line with said front protrusion and said rear protrusion, said front guide member and said rear guide member having inclined upper portions on respective sides thereof opposed to each other, for abutment with said front lower end and said rear lower end of said common rear end portion when said at least one key unit is mounted on said key support member.

28. The keyboard assembly according to claim 27, wherein said front guide member has a rear lower edge flush with said reference surface of said front protrusion, and said rear guide member has a front lower edge portion flush with said front surface of said rear protrusion.

* * * * *